US009347745B2

(12) United States Patent
Whitney

(10) Patent No.: US 9,347,745 B2
(45) Date of Patent: May 24, 2016

(54) DEHYDRATABLE PANELS

(71) Applicant: BIODYNAMIC ARMOR LTD, London (GB)

(72) Inventor: Andrew Whitney, London (GB)

(73) Assignee: BIODYNAMIC ARMOR LTD, London (GB)

( * ) Notice: Subject to any disclaimer, the term of this patent is extended or adjusted under 35 U.S.C. 154(b) by 0 days.

(21) Appl. No.: 14/418,832

(22) PCT Filed: Aug. 2, 2013

(86) PCT No.: PCT/GB2013/052077

§ 371 (c)(1),
(2) Date: Jan. 30, 2015

(87) PCT Pub. No.: WO2014/020355

PCT Pub. Date: Feb. 6, 2014

(65) Prior Publication Data

US 2015/0198424 A1 Jul. 16, 2015

(30) Foreign Application Priority Data

Aug. 2, 2012 (GB) ..... 1213775.8

(51) Int. Cl.

| | |
|---|---|
| ***F41H 5/00*** | (2006.01) |
| ***F41H 5/04*** | (2006.01) |
| ***F41H 1/02*** | (2006.01) |
| ***F41H 1/04*** | (2006.01) |
| ***B28B 13/02*** | (2006.01) |

(52) U.S. Cl.

CPC ..... *F41H 5/0478* (2013.01); *B28B 13/02* (2013.01); *F41H 1/02* (2013.01); *F41H 1/04* (2013.01); *F41H 5/04* (2013.01)

(58) Field of Classification Search

CPC ..... F41H 5/02; F41H 5/04

USPC ..... 89/36.01, 36.02, 36.04, 36.07; 135/87, 135/121, 123, 115; 428/44, 98, 137, 161, 428/172, 221

See application file for complete search history.

(56) References Cited

U.S. PATENT DOCUMENTS

| | | | | |
|---|---|---|---|---|
| 4,613,535 | A * | 9/1986 | Harpell | C08J 5/24 2/2.5 |
| 2008/0004657 | A1 * | 1/2008 | Obermiller | A61B 17/0057 606/213 |

(Continued)

FOREIGN PATENT DOCUMENTS

| | | |
|---|---|---|
| GB | 2295665 | 6/1996 |
| WO | WO 2006/114597 | 11/2006 |
| WO | WO 2006/125969 | 11/2006 |

OTHER PUBLICATIONS

International Search Report and Written Opinion mailed on Nov. 27, 2013 for International Application No. PCT/GB2013/052077, which was filed on Aug. 2, 2013 and published as WO 2014/020355 on Feb. 6, 2014. (Inventor—Whitney; Applicant—Biodynamic Armor Ltd.) (pp. 1-10).

*Primary Examiner* — J. Woodrow Eldred
(74) *Attorney, Agent, or Firm* — Ballard Spahr LLP

(57) ABSTRACT

A multilayer armored panel comprising: (I) at least one layer that is non moldable when dry but moldable when wet; (II) at least one hydrogel based layer in contact with layer (I) which, when wet enables the molding of layer (I) but which is capable of drying out to leave a non moldable layer (I).

16 Claims, 1 Drawing Sheet

(56) References Cited

U.S. PATENT DOCUMENTS

2010/0229715 A1 9/2010 Tonyan ..... 89/36.02
2011/0288566 A1* 11/2011 Kubiak ..... A61F 2/08 606/151
2012/0125726 A1 5/2012 Langhorst ..... 188/266
2012/0136313 A1 5/2012 Smith ..... 602/27
2012/0183716 A1* 7/2012 Jordan ..... B29C 70/088 428/47
2012/0264342 A1* 10/2012 Boogh ..... C08L 23/0876 442/135
2013/0331929 A1* 12/2013 Mitra ..... A61L 31/145 623/2.11
2015/0316356 A1* 11/2015 Saucedo ..... F41H 1/02 89/36.05

* cited by examiner

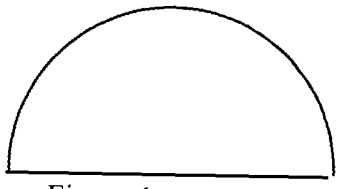
Figure 1
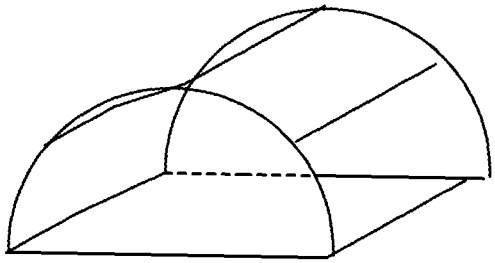
Figure 2
Figure 3
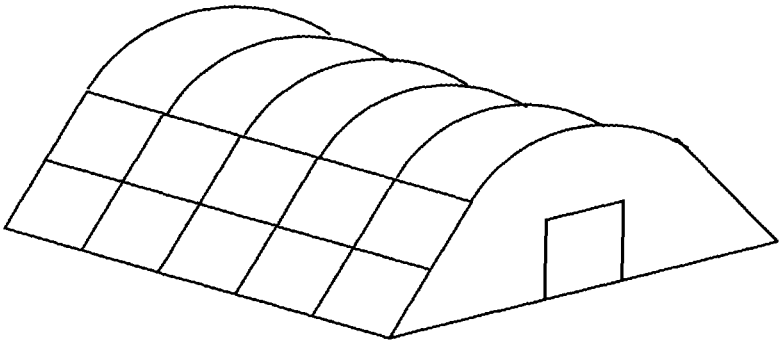

DEHYDRATABLE PANELS

CROSS-REFERENCE TO RELATED APPLICATIONS

This application is a U.S. National Phase Application of International Application No. PCT/GB2013/052077, filed on Aug. 2, 2013, which claims priority to British Patent Application No. 1213775.8, filed Aug. 2, 2012, each of which are hereby incorporated by reference in their entirety.

This invention relates to panels which can be used to protect entities such as vehicles, temporary structures or organisms from an explosion (shockwave) or projectile (bullet, shrapnel etc). In particular, the invention relates to armour panels comprising a hydrogel layer in combination with a mouldable layer to form a material which is mouldable when wet but acts as an armour or protective panel when dry.

BACKGROUND

Increased levels of insurgent warfare have led to the need to protect vehicles, structures and/or personnel from munitions typically used in this type of warfare, such as small arms fire and improvised explosive devices (IEDs). While a variety of means are available to minimize casualties from these threats, the use of suitable armour remains an important last line of defence. As a result of the need to protect a large number of potential targets while not hindering their mobility, it is also important to be able to provide armour that is lightweight and relatively inexpensive.

Armour has, of course, traditionally relied on thick layers of steel or other metals. Steel is however very heavy and inflexible, it is difficult to shape and use in all but simple configurations. Heavily armoured vehicles are therefore slow and tend to have a higher centre of gravity making them vulnerable to roll over when they encounter an angular moment such as that generated by a blast, terrain feature or sharp directional change. Steel is generally unsuitable for use in structures such as temporary buildings or tents erected in theatre.

For temporary structures, the most common method of providing ballistics protection is the use of sandbags. Hescobastions are well known large sandbags which can be used as military fortifications but they require large amounts of sand to be present in an area and possibly also an earth mover to fill them. Stacking hescobastions to provide head high armour protection is extremely difficult without lifting equipment like a fork lift.

The present inventors sought new types of armour which offer alternatives to the likes of hescobastions. In particular, the inventors sought an armour material that can be moulded into shape in the field and which is lightweight. As noted above, armour materials tend to be hard and inflexible. It is difficult to mould armour into curved shapes without the use of moulds and enormous temperatures to melt the armour before use. Moreover, armouring temporary structures erected in the field of battle is very difficult. Whilst sandbags are often used for this purpose, these are heavy and are limited by a ready source of sand. They cannot really be moulded to any fixed shape.

The present inventors offer a solution to this problem. By using a multilayer structure having at least a hydrogel based layer and an armour layer that becomes mouldable when wet but non mouldable when dry, the inventors can offer armours that are mouldable. Thus, armour could be moulded to fit the side of a vehicle or temporary structure by wetting it. Thereafter, the armour dries out naturally in the sun, becomes non mouldable but retains the moulded shape.

No one before has considered the idea of mouldable armour based on hydration and dehydration thereof.

SUMMARY OF INVENTION

Viewed from one aspect the invention provides a multilayer armoured panel comprising:

(I) at least one layer that is non mouldable when dry but mouldable when wet;

(II) at least one hydrogel based layer in contact with layer (I) which, when wet enables the moulding of layer (I) but which is capable of drying out to leave a non mouldable layer (I).

Viewed from another aspect the invention provides a multilayer armoured panel comprising:

(I) at least one layer that is non mouldable but can be made mouldable when wet;

(II) at least one gel based layer in contact with layer (I) which, when water is added becomes a hydrogel layer and enables the moulding of layer (I). Viewed from another aspect the invention provides a multilayer armoured panel comprising:

(I) at least one layer that is mouldable;

(II) at least one hydrogel based layer in contact with layer (I) which is wet and enables the moulding of layer (I) but which is capable of drying out to leave a substantially rigid, moulded layer (I).

Viewed from another aspect the invention provides a process for forming an armoured panel comprising providing a multilayer panel comprising:

(I) at least one layer that is non mouldable when dry but mouldable when wet;

(II) at least one hydrogel based layer in contact with layer (I);

moulding layers (I) and (II) into a desired shape and allowing said hydrogel layer to dry which to leave a non mouldable layer (I).

A structure formed from a mouldable and dehydratable panel as hereinbefore described forms a still yet further aspect of the invention, such as a tent.

Tents are an especially preferred structure. Thus, viewed from another aspect the invention provides a kit for building a tent comprising a frame, which when erected comprises slots into which can be attached (I) a layer that is non mouldable when dry but mouldable when wet;

(II) a hydrogel based layer in contact with layer (I) which is wet and enables the moulding of layer (I) to the shape of the frame but which is capable of drying out to leave a non mouldable layer (I).

Viewed from another aspect the invention provides the use of an armour as hereinbefore described to protect an entity from pressure impulse, e.g. a bullet, grenade fragment or other blast particle.

Viewed from another aspect the invention provides an entity such as a vehicle, helmet, temporary structure or body armour comprising an armour panel as hereinbefore defined.

DEFINITIONS

The term pressure impulse mitigation covers mitigating the effects of contact with an explosion or projectile, i.e. mitigating the potential damage caused by a projectile or in the mitigation of projectile induced damage. The projectile may be, for example, a bullet, missile, shrapnel, etc. A pressure impulse mitigating barrier is therefore capable of mitigating these effects. The term pressure impulse mitigation also covers stopping the threat offered by a projectile. Panels of the invention should be capable therefore of stopping a projectile such as small aims fire, i.e. preventing small arms from penetrating the panel.

By entity is meant anything which should be protected from the impact of an explosion or from damage by a projectile, e.g. structures, organisms and the general physical environment.

An organism is a living plant or animal, e.g. a human. By structure is meant any inanimate object which could be protected from explosive damage such as buildings (temporary or permanent), industrial plant, civil infrastructure, vehicles, military equipment, computers etc.

The term mouldable means the layer in question can be manipulated into a particular shape and retains that shape.

The term non mouldable means that the layer in question does not retain a shape into which it is forced. Thus, a non mouldable layer might be rigid (non bendable) or pliable but would return to its original shape when force is removed. Such a layer might therefore be rigid or pliable.

DETAILED DESCRIPTION OF THE INVENTION

The present invention relates to armour panels that are mouldable by virtue of their ability to be hydrated and dehydrated. The term armour is used here to imply that the panels of the invention in wet or preferably dry form, offer protection against pressure impulse. In particular, panels of the invention are designed to withstand contact with projectiles, more particularly small arms fire. Ideally therefore the armour panels of the invention will be able to withstand a hit from a small arms rifle, i.e. one firing bullets of 7.62 mm caliber or less. Ideally, if used in a heavier configuration, the panels will be able to withstand higher energy threats. For example, the panels may resist flying debris from exploding or fragmenting machines or engines. The panels might therefore be used in jet engine shrouds to protect superstructure from engine components.

By withstand such bullets is meant simply that the bullet does not penetrate the panel.

By using a hydrogel layer in contact with an armouring layer of material that becomes mouldable in contact with that hydrogel layer, we can provide a mouldable armour panel. When the sun dries out the hydrogel layer, the mouldable layer also dries and becomes rigid and strong.

We believe no one has previously considered the use of wettable armour panels as a means to make mouldable armoured structures. No one has appreciated how these materials might have critical uses such as in the walls and roofs of temporary structures erected in the field of warfare, especially tents, command posts, or bunkers.

Hydrogel

The panels of the invention will contain at least one hydrogel layer when wet. When dehydrated, what remains is simply the gel material used to form the hydrogel. In its dry form, the gel material is preferably solid and might actually be brittle but the gel is not there to provide strength in its dry form.

By hydrogel is meant a mixture of water and a gel which forms a solid elastomeric material. The gel should preferably be non-toxic and cheap to manufacture or isolate. It should exhibit elastomeric properties, have a high elastomeric modulus and a high ductility.

Suitable gels include gelatin, gellan gum gels, poly (gamma-benzyl-L-glutamate) (PBLG), agar (preferably composed of 70% agarose, a gelsaccharide and 30% agaropectin), collagen, protein gels, polysaccharide gels, keratin gels, hydrogels, ormosils (organically modified silicates often of formula (R'nSi(OR)4-n in which R is typically an alkyl group and R' an organic group), sol-gels, hydrophilic polymer gels, and glycoprotein gels. Other suitable gels include biogels such as carrageenans, pectins, alginates (e.g. xanthan alginates casein), seed gums, egg protein g and Gelacrimide gels. Mixtures of gels can be employed.

These gels can be obtained from commercial sources. A preferred gel is gelatin.

The mixture of water and gel can comprise at least 3% by weight of the gel, preferably at least 4% by weight gel, especially at least 5% by weight gel, up to the limit of solubility of the gel in water, e.g. between 3% by weight and 40% by weight of gel, or in the range 4% by weight to 25% by weight gel, e.g. 5 to 10% wt. The preferred gelatin used in the invention has a molecular weight range of 20,000 to 300,000 D, e.g. 20,000 to 150,000 D and can be made from the hydrolysis of collagen.

More preferably the hydrogel is crosslinked. Suitable agents to effect the cross-linking of the gels are multifunctional molecules, e.g. bi, tri or tetrafunctional molecules, capable of linking the polymer chains of the gel in question. The reactive functionalities on the cross-linking agent are conveniently the same and these can be separated by spacer groups. Such a spacer group may preferably comprise a chain of 1 to 20 atoms, e.g. an alkylene chain optional interrupted by heteroatoms such as 0, linking the reactive functional groups. The spacer group chain length actually selected will depend upon the water gel polymer to be cross linked and the mechanical and physical properties required of the cross linked gel. Suitable reactive cross-linking functional groups are well known and include aldehydes, esters (in particular N-hydroxy succinimide esters and imidoesters), amines, thiols, hydroxyls, acid halides, vinyls, epoxides and the like.

Thus, cross-linking agents may be of general formula (I)

$$X\text{-}Sp\text{-}X \qquad (I)$$

wherein each X independently represents the residue of an aldehyde (i.e. —COH), the residue of an ester (i.e. —COOR) in particular N-hydroxy succinimide esters and imidoesters, amine, thiol, hydroxyl, acid halide or vinyl and Sp is a spacer group comprising a chain of 1 to 20 atoms in its backbone, preferably 4 to 12 atoms, e.g. 5 to 10 atoms.

Alternatively, the cross-linking agent may be a multifunctional species of formula (II)

$$(X\text{-}Sp)_n Y$$

wherein X and Sp are as hereinbefore defined, Y is a carbon atom, C—H or a heteroatom such as a nitrogen or phosphorus atom and n is 3 to 5. Obviously, the value of n varies depending on the nature of the Y atom employed as will be readily understood by the person skilled in the art. Thus when Y is C then n is 4. If Y is C—H then n is 3.

Preferred groups X are electrophilic functional groups such as esters, carboxylic acids or aldehydes or nucleophilic groups such as amines and hydroxyls.

Whilst the X groups may be different, especially preferably, all X groups are the same and are selected from aldehydes and esters, in particular imidoesters or N-hydroxy succinimidyl esters.

The spacer chain is preferably linear and formed from a carbon atom backbone, e.g. a $C_{1-20}$ alkylene chain, preferably methylene or a $C_{7-9}$ alkylene chain. Such a backbone may be interrupted by heteroatoms, e.g. oxygen or nitrogen, to form for example, an ether spacer group. Again whilst the Sp groups may all be different, it is preferred if these are the same.

When Y is a heteroatom it is obviously one which can have a valency of at least 3, e.g S, N, P.

Preferably, Y is a nitrogen atom or a phosphorous atom. The subscript n is preferably 3 when Y is nitrogen and 3, 4 or 5, especially 4, when Y is phosphorous.

Specific cross-linking agents of particular utility in the invention include sebacic acid esters (e.g. the N-succinimidyl ester whose structure is depicted below), bis(sulphosuccinimidyl) suberate, imidoesters such as dimethyl suberimidate, trissuccinimdyl aminotriacetate (TSAT, Pierce Biotechnology Inc.), beta-tris(hydroxylmethylphosphino) propionic acid (THPP, Pierce Biotechnology Inc.), avidin-biotin.

Scheme 1. Sebacic Acid bis (N-succinimidyl) ester (SANHSE)

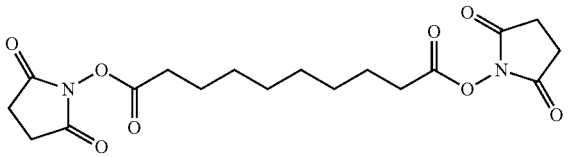

The SANHSE, in common with other bis-succinimidyl derivatives, is easily synthesised by condensing N-Hydroxysuccinimide with a dicarboxylic acid in the presence of dicyclohexylcarboiimide, the carboxylic acid being selected to provide a spacer of desired length. The resulting product contains two amine-reactive N-hydroxysuccinimide esters. This compound exhibits poor water solubility however. Hydrophilicity (and hence solubility) can therefore be increased by the addition of a sulfonate group into the succinimidyl ring. A number of water soluble bis-succinimidyl cross linkers are now commercially available from PIERCE (e.g. Bis(sulfosuccinimidyl) suberate (BS3).

The cross-linked mixture of water and gel can comprise at least 3% by weight of the gel, preferably at least 4% by weight gel, especially at least 5% by weight gel, up to the limit of solubility of the gel in water, e.g. between 10% by weight and 50% by weight of gel, or in the range 15% by weight to 40% by weight gel, e.g. 20 to 35% wt.

Mixing of the water and gel can be achieved by any convenient means, preferably with stirring or sonication to ensure complete mixing. Thus, the hot gel can be mixed with water in a mould and allowed to cool to form the water gel. The water used may be deionised or distilled if desired but this is not essential. Other sources of water such as tap water are also employable.

The cross-linking of the water gel can be carried out using any suitable protocol. Thus, the cross-linking agent could simply be added to an appropriate concentration of water gel mixture at a suitable pH to effect cross-linking. For example, cross-linking may be effected by the addition of an aqueous solution of a water soluble imidoester, such as dimethyl suberimidate.2HCl (DMS), to 20-35% w/v gelatin in aqueous solution, in PBS or other suitable buffer. An appropriate pH for the addition would be in the range 7.5 and 9.5 and temperatures of 20 to 40° C., e.g. 30-35° C. or 22-24° C. could be employed.

The concentration of cross-linker employed may be between 0.25 and 25 mM, e.g. 10 to 20 mM giving, in the case of gelatin, a molar ratio of amino groups to reagent of between 1:2 to 1:5.

The hydrogel layer in the panels of the invention is therefore preferably formed by a crosslinked blend of water and gelatin.

The hydrogel layer may be 1 mm to 3 cm in thickness when wet, preferably 5 mm to 2 cm in thickness. This layer may contract when dry.

As will be noted in more detail below, it is likely that armour panels of the invention will contain a plurality of hydrogel layers.

Mouldable Layer

The panels of the invention also comprise at least one mouldable layer. In order to make sure this layer is mouldable, it has to be wetted by the hydrogel layer. These layers are therefore preferably adjacent or at least separated by a water permeable layer. The mouldable layer is one which is rigid in its dry state and therefore provides stiffness and strength to the panel but when contacted by the hydrogel layer, it becomes mouldable.

The term mouldable is used herein to imply that the shape of the panel can be manipulated, perhaps to fit the frame of a tent. The manipulation is preferably carried out manually. The panels are preferably so mouldable that a human can mould then into appropriate shapes as opposed to only a machine.

It will be appreciated that the term mouldable is used to imply that curved panels can be formed and the like. Each panel might therefore be convex or concave after moulding, or include features such as ridges and other shapes.

The mouldable layer can be formed from any convenient material but is typically a polymer fibre composite. Such a composite might be formed from aramid fibre, carbon fibre, nylon, fibreglass or a polyolefin.

The mouldable layer preferably comprises to a cross-ply of multiple layers of a material which is then itself compressed under heat and pressure in an autoclave to form a very hard, very thin layer. There can be 40 to 100 individual sheets in each mouldable layer.

The mouldable layer preferably comprises a polyethylene especially an ultra-high-molecular-weight polyethylene (UHMWPE). The weight average Mw of these polymers will typically be in excess of 1 million (measured by intrinsic viscosity) usually between 2 and 6 million. These polymers are available commercially from suppliers such as Dyneema.

Ultra high Mw polyethylene is inherently very inflexible. The invention may enable the rapid and easy moulding of this inherently inflexible material.

The mouldable layer may be 0.5 to 20 mm in thickness, preferably 1 to 10 mm in thickness when dry. When contacted by the hydrogel layer the mouldable layer may expand.

It is possible for the mouldable layer of the invention to comprise a mixture of two or more components. Preferably, however the mouldable layers are formed from a single material (other than possible additives).

It is preferred if the panels of the invention comprise multiple hydrogel layers and mouldable layers, especially in alternating order. There can be at least 2 of each layer, such as at least 3 of each layer type. The panels might contain different mouldable layers and/or different hydrogel layers, such as an aramid layer and a UHMWPE layer and so on. Preferably however the materials used to form each hydrogel layer will be the same and the materials used to form the mouldable layer will be the same.

It will be preferred if the mouldable layers form the outer layer of the panels relative to the hydrogel layers. Thus a panel might comprise layers MHMHM or MHMHMHM and the like where M is mouldable layer and H is the hydrogel layer.

Thus alternating layers of 1 to 3 mm in thickness could be used, e.g. to form an overall panel of 1 to 2 cm in thickness. The presence of the hydrogel and thin mouldable layers therefore makes the formation of a mouldable panel easier.

It will be appreciated that the panels of the invention may also contain other layers, in particular other outer layers such as camouflage layers or wet resistant layers to stop water penetration once the armour has dried. It may also be beneficial to use slat armour layers with the panels of the invention.

A potential problem with the use of hydrogel layers, in combination with mouldable layers that will be armours when dry, is compatibility between the hydrophilic hydrogel layer and the mouldable layer. If that layer is Dyneema for example, that material is hydrophobic making the interaction of the two layers difficult. It might be therefore that the layers are linked via an "emulsifying" layer or are functionalised to allow better interaction of the layers.

It may be necessary to treat the mouldable layer to enhance interaction between the layers in the armour panels. For example, by introducing a hydrophilic monomer into a polymer which makes the mouldable layer, better interaction between the mouldable layer and the hydrogel layer might be encouraged. Suitable monomers include (meth)acrylate monomers or vinyl alcohol monomers. In general any monomer that provides polarity might be used.

The use of silane primers to enhance interaction between the layers in the panel is a further option.

In some embodiments, it is preferred to provide a synthetic fibre layer such as a Kevlar type layer (i.e. a layer of formula $(—CO—C_6H_4—CO—NH—C_6H_4—NH—)_n$) as part of the panel. The use of a synthetic fibre such as Kevlar or similar para-aramids adjacent the mouldable may enhance laminate strength.

Panels

The armour panels of the invention can be made as thick or thin as desired. Thinner panels will of course be easier to mould but less strong. Ideally, they are as thin as possible whilst having the necessary ballistic resistance. The panels may be 5 to 50 mm such as 10 to 25 mm in their dry state. It will also be possible to vary the thickness of the sheet along its length so that thicker areas are present in areas where particular protection is needed. The other dimensions of the armour panels will be dictated by the nature of the entity which is being protected by the panel.

There is also an optimum size for each panel. Having a plurality of smaller panels enhances performance by preventing cracking propagation through a whole panel. Dimensions may be up to 2 m by 2 m, such as no more than 1.55 m in length/width, preferably in the range 80 cm to 140 cm in length and width. The panels can be any shape but are preferably shaped to pack, e.g. squares, rectangles, hexagons and so on.

Any panel of this invention may additionally comprise other layers not mentioned above as long as these layers are also mouldable. For example, panels might comprise a fibreglass layer, or a dilatant layer (e.g. polyethylene glycol layer). A fibreglass layer is especially useful as a front layer on the panel. Moreover, it is within the scope of the invention to overlap layers to maximise strength.

A dilatant is a material which thickens upon applied shear stress, e.g. may turn solid upon applied shear stress and examples thereof are polyethylene glycols and silicones.

The armour panels of the invention are inherently fire resistant when wet due to the additional $H_2O$ present in the gel matrix, and the gel still retains some $H_2O$/fire resistant properties when in the 'dry' state, which brings an evaporative benefit on contact with heat sources. Further backing layers may be incorporated in the panel to deliver additional resistance to hot and/or molten particles, e.g. partially-oxidised PAN (pyrolized poly acrylo nitrile) layers, and/or other proprietary materials.

Conventional fire retardants could be used in this regard. It is particularly preferred to use a fire retardant layer based on a carbon fibre fabric.

Disruptor Particle Layer

In some embodiments, the panels of the invention can be provided with a layer of particles, as long as this layer remains mouldable. The armour panel of the invention may therefore comprise at least one layer comprising a plurality of disrupter particles. By disrupter particles is meant irregular or preferably regular shaped particles, e.g. spheres of material. The disrupter particle layer is preferably embedded within an adhesive such as an epoxy resin.

The disrupter particles may be formed from a wide variety of materials such as fibreglass, graphite, stone (sandstone, quartz, basalt, flint, pumice), metals (steel), glass (e.g. hollow spheres of glass), polymers (e.g. polyethylene) but are preferably ceramic particles.

By ceramic is meant inorganic non-metallic material such as alumina, beryllia, steatite or sterite, whose final characteristics are produced by subjection to high temperatures, e.g. in a kiln. Often the ceramic material derives from clay.

Preferred ceramic materials are aluminium oxide, zirconia toughened alumina, precipitation strengthened alumina, magnesium oxide, SiAlON (Silicon oxy-nitride), silicon carbide, silicon nitride, silicon oxide, boron carbide, aluminium borides, boron nitride, titanium diboride or more generally from a group of oxides, boride, carbides, nitrides of alkaline earth, Group IIA IIIB, IVB and transition metals and mixtures thereof.

In addition, metal matrix composite containing ceramic phase are also suitable. The use of carbides and in particular SiC is especially preferred. One of the other benefits of the disrupter layer is that it might deliver the same performance/threat defeat at not only same/less areal density, but might also be so effective as to permit the use of cheaper, low grade ceramics. It would be a major benefit to use alumina in armour systems rather much more expensive carbides.

Ceramic particles of use in the invention may be manufactured as is known in the art from materials discussed above although preferably these are formed from aluminium oxide, silicon carbide or silicon nitride. Aluminium oxide ceramic particles may be at least 98%, e.g. at least 99% alumina and may have a Vickers hardness of at least 1300, e.g. at least 1700 Hv. They may also have a modulus of elasticity of 300 to 400 $kNmm^{-2}$, e.g. 350 $kNmm^{-2}$, a fracture toughness of 10 to 20 $MPam^{-2}$, e.g. 13.5 $MPam^{-2}$ and an ultimate compressive strength of 1 to 5 $kNmm^{-2}$, e.g. 2.5 $kNmm^{-2}$.

Silicon nitride ceramic balls ($Si_3N_4$), may comprise between 80 and 90%, e.g. 87% silicon nitride and may have a Vickers hardness of at least 1300, e.g. at least 1400 Hv, such as 1400 to 1700 Hv. They may also have a modulus of elasticity of 250 to 400 $kNmm^{-2}$, e.g. 310 $kNmm^{-2}$, a fracture toughness of 4 to 10 $MPam^{-2}$, e.g. 6 to 8 $MPam^{-2}$ and an ultimate compressive strength of 2 to 7 $kNmm^{-2}$, e.g. 4 $kNmm^{-2}$ The use of Silicon carbide is especially preferred. Silicon carbide ceramic balls (SiC), may comprise between 80 and 90%, silicon carbide and may have a Vickers hardness of at least 1300, e.g. at least 1400 Hv, such as 1400 to 1700 Hv. They may also have a modulus of elasticity of 250 to 400 $kNmm^{-2}$, e.g 310 $kNmm^{-2}$, a fracture toughness of 4 to 10 $MPam^{-2}$, e.g. 6 to 8 $MPam^2$ and an ultimate compressive strength of 2 to 7 $kNmm^{-2}$, e.g. 4 $kNmm^{-2}$.

All the ceramics of use in the invention are inert, non-toxic and essentially unaffected by heat (they will function at temperatures of greater than 1000° C.) making them ideal for use in the panels of the invention.

The size of the disrupter particles may vary over a broad range. Preferred diameters range from 0.1 mm to 20 mm, preferably 0.5 to 10 mm, e.g. 1 to 5 mm. It may also be possible to use particularly small disrupter particles of the order of 10 to 1000 microns in diameter. Such miniature particles are generally hollow ceramic spheres (e.g. formed of sodium borosilicate). Preferred ceramic spheres are solid. It will be appreciated that all the particles should be of approximately the same size in order to allow easy packing. Thus particle size distribution should preferably be narrow, e.g. all particles should have diameters within 10% of the mean, preferably within 5% of the mean.

Preferably the disrupter particles are regularly shaped so that they pack using a minimum amount of space. Suitable shapes therefore include cubes and cuboids, a honeycomb type structure or spherical structures, e.g. ovoid or spheres. The particles are preferably spherical.

The overall thickness of the disrupter particle layer may be 2 to 20 mm in thickness, preferably 3 to 10 mm in thickness. It will be appreciated that thicker layers tends to mean stronger panels but extra weight. The idea here is to maximise strength whilst minimising weight. The dimensions above are a compromise therefore between strength and weight.

Adhesive

It is preferred if the disrupter particle layer is set in an adhesive such as an epoxy resin. The armour panel of the invention preferably comprises an epoxy resin layer. Epoxy resins are thermosetting polymers formed from reaction of an epoxide resin with a polyamine hardener and are widely commercially available. The disrupter particles discussed above are preferably embedded in this resin.

Epoxy resins are therefore copolymers. Most common epoxy resins are produced from a reaction between epichlorohydrin and bisphenol-A. The hardener consists of polyamine monomers, for example triethylenetetramine (TETA). When these compounds are mixed together, the amine groups react with the epoxide groups to form a covalent bond. Each NH group can react with an epoxide group, so that the resulting polymer is heavily crosslinked, and is thus rigid and strong.

The process of polymerization is called curing, and can be controlled through temperature, choice of resin and hardener compounds, and the ratio of said compounds.

Any suitable epoxy resin can be used in the invention.

The thickness of additional layers can of course vary depending on the nature of the material involved. Suitable thicknesses range from 1 to 10 mm.

Manufacture

The panels of the invention might be manufactured within a frame, such as a metal, rubber or wooden frame. That frame is preferably removeable once the layers have been formed in order to allow moulding of the panel. In order to first manufacture a panel of the invention, it is preferred if the layers of hydrogel and mouldable material are introduced sequentially in order to form a panel of the invention. Any other layers with form part of the panel can also be introduced at this stage.

It will be preferred at this stage if the panel is then dried ready for transportation. The panel can be rehydrated in the field for moulding.

The wet panel can then be moulded, e.g. curved into a desired shape, such as the side of a tent. The panel is then dried out. Drying can be effected using a heating mechanism but ideally, the panel should just dry naturally in the sun.

It will be appreciated that once dried, it may be desirable to ensure that the panel remains dry. The formed panels may need to be covered therefore by a tarpaulin or the like. This may conveniently also provide camouflage to the panel.

Panels can be transported in their dry state for wetting and moulding in their final locations. The fact that panels can be transported in their dry state has major implications in terms of cost as the dry panels are comparatively light and less bulky. Lighter panels means they are cheaper to transport using less fuel and providing environmental benefit.

In order to allow easy evaporation of water, it is possible to provide the mouldable layer with tiny holes that allow water to pass through in gaseous form.

It is also envisaged that the panels might be staggered to enable drying to take place.

Applications

The panels of the invention can be used anywhere were armour panels are needed, in particular where temporary armour panels are needed to protect against a threat such as small arms fire. The panels can be used in body armour as well as in vehicle armour.

A particularly interesting application is in the fabrication of temporary buildings. The armour panels of the invention might be used as walls or roofs of temporary structures. These panels offer a much better resistance to a threat such as small arms fire than conventional solutions such as canvas walls. Moreover, they are rapidly deployed in the field and can be used in locations where sandbags cannot. Moreover to stack sandbags to head height takes time, a lot of sand and possibly earth moving equipment.

Armour panels of the invention can offer a solution to wall protection in temporary structures in any location where water is available.

A most preferred application is therefore tents. Military personnel often sleep in tents in the field. Tents are used as social areas, eating/cooking areas, hospitals and so on. Tents are not conventionally armoured at all, leaving soldiers vulnerable to small arms fire and fragmentation from grenades, mortars and LEDs. The mouldable panels of the invention offer potential to form an armoured tent in the field.

Large tents are usually constructed using a frame and a canvas cover over that frame. By using an adapted tent frame, the present inventors teach that a wet panel of the invention can be placed in appropriate slots in a frame and moulded so as to form the well known curved tent shape. The panel can be moulded to the shape of the tent as desired. In many climates such as the middle east, the water within the hydrogel layer can then evaporate. This has a cooling effect making the tents temporarily "air conditioned" and also leaves a rigid armour panel which acts as a pressure impulse mitigation material.

The principles described above would therefore be applicable to any temporary construction whether in a military or non military environment.

Thus, the barriers of the invention have a range of applications from bullet proof vests and helmets to replacement for sandbags to protect army personnel from enemy fire. The armour panels may also be used as vehicle armour. Many troop transport vehicles have canvas side walls which are vulnerable to small arms fire. The panels of the invention may be used in that environment.

The panels might be moulded to cover water based inflatables. Fast launches used by marines are often inflatables which are obviously susceptible to bursting with small arms fire. Panels of the invention can be applied to the boat on land, moulded around the hull of the boat and dried out. These can then prevent damage to the boat from small arms fire. Precautions can of course be taken to stop water rewetting the dried panel. However, the panels of the invention are also pressure impulse mitigating barriers in wet form.

It may be therefore that a boat is provided with a skirt which has a range of ballistic performance depending on the wetness present.

In theory, a boat could be made from the armour of the invention. The wet panels of the invention could be moulded into the appropriate boat shape on land and dried out to leave a solid vessel. After the addition of a protective layer to prevent the layers being wetted in water, the vessel could be used.

Fixing the barrier to a structure can be achieved using conventional techniques. For example, structures can simply be provided with slots into which panels can be slotted. A tent frame can have slots for panels of the invention or the panels might be adhered to a surface. Many ways of mounting panels will be obvious to the skilled person.

The invention will now be further described with reference to the following non-limiting examples and FIGS. 1 to 3. FIGS. 1 to 3 are alternative depictions of tent structures.

FIG. 1 is a end view of a tent in which the panels of the invention form the walls/roof.

FIG. 2 is a 3-D depiction of the FIG. 1 tent.

FIG. 3 is a more complex tent design in which panels of the invention can be used either flat or curved.

EXAMPLE 1

Panel Manufacture

A layer of Dynemma is placed into a bendable rubber frame, 50 cm by 50 cm in diameter. The Dynemma layer is 1 mm in thickness.

Hydrogel Layer—Preincubation 5000 ml of 2% w/v gelatin was prepared in Peptone Buffer Saline (PBS) and allowed to cool slowly to room temperature. The pH of this 2% solution was then adjusted to pH 8.0. This 2% solution was maintained at temperatures between 22-24° C.

Sebacic acid bis N-succinimidyl ester (SANHSE) was prepared immediately prior to use. The reactions described were carried out at a reagent concentration of 5 mM. The SANHSE samples were solubilised/emulsified in 100 ml of 95% methanol (20 g in 100 ml of methanol).

The gelatin solution was placed on a magnetic stirrer and spun into a vortex. The reagent was added and the solution allowed to spin for a further 30 seconds to allow complete dispersal. The samples were maintained at 22-24° C. for 4 hours. Every 15-20 minutes the tubes were gently agitated by rotating them 3-4 times to disperse any SANHSE that was not fully solubilised.

Second Stage

At the end of the pre-incubation period the reacted 2% gelatin was mixed with 15000 ml of concentrated gelatin solution (20% w/v) that had been adjusted to pH 8.0 and was maintained at 38-48° C. The mixing was carried out for 30 s to ensure complete miscibility of the two gelatin solutions.

Immediately after the mixing was complete the mixed sample is added to the Dyneema layer at room temperature (18-20° C.).

This layer is applied in 1 mm thickness onto the Dyneema layer (1 mm) in the frame. The moisture in the gel layer is allowed to contact the Dyneema.

The whole apparatus is then bent by rolling the Dyneema layer over a tubular dowel so as to form a concave/convex surface.

After moulding, the panel is passed into an oven at 30° C. to evaporate the water from the gel layer. After evaporation, the panel is removed from the frame to leave a solid, curved Dyneema panel of appropriately 1-2 mm in thickness and 50×50 cm.

EXAMPLE 2

The process of example 1 is repeated using alternate layers of 1 mm dyneema and 1 mm of gel so as to form a panel of 1 cm in thickness. The whole apparatus is then bent by rolling the Dyneema layer over a tubular dowel so as to form a concave/convex surface.

The invention claimed is:

1. A multilayer armoured panel comprising:
(I) at least one layer that is non mouldable when dry but mouldable when wet;
(II) at least one hydrogel based layer in contact with layer (I) which, when wet enables the moulding of layer (I) but which is capable of drying out to leave a non mouldable layer (I).

2. A multilayer armoured panel comprising:
(I) at least one layer that is non mouldable but can be made mouldable when wet;
(II) at least one gel based layer in contact with layer (I) which, when water is added becomes a hydrogel layer and enables the moulding of layer (I).

3. A multilayer armoured panel comprising:
(I) at least one layer that is mouldable;
(II) at least one hydrogel based layer in contact with layer (I) which is wet and enables the moulding of layer (I) but which is capable of drying out to leave a non mouldable, moulded layer (I).

4. The panel as claimed in claim 1 in which the hydrogel layer comprises gelatin and water.

5. The panel as claimed in claim 1 in which the mouldable layer comprises an ultra high molecular weight polyethylene.

6. The panel as claimed in claim 1 in which there are multiple hydrogel and mouldable layers.

7. The panel as claimed in claim 1 further comprising a synthetic fibre layer.

8. The panel as claimed in claim 1 further comprising a fire retardant layer.

9. A process for forming an armoured multilayer panel comprising providing:
(I) at least one layer that is non mouldable when dry but mouldable when wet; and
(II) at least one hydrogel based layer in contact with layer (I);
moulding layers (I) and (II) into a desired shape and allowing said hydrogel layer to dry thereby leaving a non mouldable layer (I).

10. The process as claimed in claim 9 comprising providing a panel comprising at least 3 alternate layers (I), (II), (I) and moulding said alternate layers into a desired shape.

11. A kit for building a tent comprising a frame, which when erected comprises slots into which can be attached
(I) a layer that is non mouldable when dry but mouldable when wet;
(II) a hydrogel based layer in contact with layer (I) which is wet and enables the moulding of layer (I) to the shape of the frame but which is capable of drying out to leave a non mouldable layer (I).

12. The panel as claimed in claim 1, wherein the panel protects an entity from a pressure impulse.

13. An article comprising the armour panel as claimed in claim 1.

14. The article of claim 13, wherein the article is a vehicle, helmet, temporary structure, or body armour.

15. The article of claim 13, wherein the article is a tent.

16. The panel of claim 7, wherein the synthetic fibre is a para aramid.

* * * * *